US005512188A

United States Patent [19]

Kinoshita et al.

[11] Patent Number: 5,512,188

[45] Date of Patent: Apr. 30, 1996

[54] GREASE COMPOSITION FOR CONSTANT VELOCITY JOINT COMPRISING BORON NITRIDE POWDER AND ZINC DITHIOPHOSPHATE

[75] Inventors: Hirotugu Kinoshita, Yokohama; Souichi Nomura, Tokyo; Masaru Mishima, Kawasaki, all of Japan

[73] Assignee: Nippon Oil Co., Ltd., Tokyo, Japan

[21] Appl. No.: 514,387

[22] Filed: Aug. 11, 1995

Related U.S. Application Data

[63] Continuation of Ser. No. 115,457, Sep. 1, 1993, abandoned, which is a continuation of Ser. No. 846,357, Mar. 5, 1992, abandoned.

[30] Foreign Application Priority Data

Mar. 7, 1991 [JP] Japan ..... 3-042081

[51] Int. Cl.$^6$ ..... C10M 125/26; C10M 123/02

[52] U.S. Cl. ..... 252/18; 252/25

[58] Field of Search ..... 252/18, 25, 32.7 E

[56] References Cited

U.S. PATENT DOCUMENTS

| | | | |
|---|---|---|---|
| 2,837,549 | 6/1958 | Reeves et al. | 252/32.7 E |
| 3,017,361 | 1/1962 | Morris et al. | 252/35 |
| 3,196,109 | 7/1965 | Morway et al. | 252/25 |
| 3,345,290 | 10/1967 | Strohmaier | 252/25 |
| 3,607,747 | 9/1971 | Ishikawa et al. | 252/18 |
| 3,669,884 | 6/1972 | Wright | 252/36 |
| 4,115,284 | 9/1978 | Kinoshita et al. | 252/25 |
| 4,168,241 | 9/1979 | Kozima et al. | 252/18 |
| 4,436,649 | 3/1984 | Stemke | 252/25 |
| 4,915,860 | 4/1990 | Kinoshita et al. | 252/51.5 A |
| 5,000,862 | 3/1991 | Waynick | 252/11 |
| 5,043,085 | 8/1991 | Kinoshita et al. | 252/51.5 A |
| 5,462,683 | 10/1995 | Kinoshita et al. | 252/25 |

FOREIGN PATENT DOCUMENTS

| | | |
|---|---|---|
| 233757 | 8/1987 | European Pat. Off. . |
| 0233757 | 8/1987 | European Pat. Off. . |
| 296362 | 12/1987 | European Pat. Off. . |
| 0296362 | 12/1988 | European Pat. Off. . |
| 386653 | 9/1990 | European Pat. Off. . |
| 0386653 | 9/1990 | European Pat. Off. . |
| 0453565 | 10/1991 | European Pat. Off. . |
| 453565 | 10/1991 | European Pat. Off. . |
| 55-092800 | 7/1980 | Japan . |
| 2185492 | 7/1987 | United Kingdom . |

OTHER PUBLICATIONS

Smalheer et al., "Lubricant Additives", pp. 1–11, 1967.

*Primary Examiner*—Jerry D. Johnson
*Attorney, Agent, or Firm*—Darby & Darby

[57] ABSTRACT

A grease composition for a constant velocity joint involves a base oil containing a thickener and boron nitride powders and optionally an organozinc compound.

19 Claims, No Drawings

GREASE COMPOSITION FOR CONSTANT VELOCITY JOINT COMPRISING BORON NITRIDE POWDER AND ZINC DITHIOPHOSPHATE

This is a continuation of application Ser. No. 08/115,457, filed Sep. 1, 1993, now abandoned which is a continuation of Ser. No. 07/846,357, filed Mar. 5, 1992, now abandoned.

BACKGROUND OF THE INVENTION

The present invention relates to a grease composition for a constant velocity joint or a fixed type joint and slide type joint.

In general, a combination of a fixed type joint, a shaft and a thrust type joint is employed when a constant velocity joint is applied in FF type or front wheel driven type cars.

Examples of fixed-type joints include Birfield joints, Rzeppa joints, undercutting free joints and tripod joints. Examples of slide-type joints include double off-set joints, tripod joints, and closs groove joints.

Constant velocity joints are generally lubricated with an extreme pressure grease made up of a base grease consisting of a purified mineral oil, a lithium soap and an urea thickner which is combined with molybdenum disulfide, a sulfur-phosphorus compound, a lead compound, etc.

In the grease composition for the constant velocity joint, there are required characteristics such as anti-flaking, anti-seizure, abrasion resistance or low friction properties. However, conventional grease compositions are generally lacking in these areas. In particular, in the view of a prolonged life time of the constant velocity joint, it has been desired to improve the anti-flaking performance.

SUMMARY OF THE INVENTION

It is an object of the present invention to provide a grease composition for a constant velocity joint which is superior in anti-flaking performance prolonging the a life time of the constant velocity joint.

The above and other objects of the present invention will become apparent from the following description.

According to the present invention, there is provided a grease composition for a constant velocity joint comprising a base oil containing a thickener and boron nitride powders and optionally an organozinc compound.

PREFERRED EMBODIMENTS OF THE INVENTION

The present invention will be explained in more detail hereinbelow.

Any oils such as a petroleum lube base oil and a synthetic lube base oil commonly used as the lube base oil may be employed as the base oil in the present invention. petroleum lube base oil may be preferably employed. Examples of petroleum lube base oils, include paraffin lube base oil, naphthene lube base oil and the like obtained by subjecting lubricant fractions obtained by distillation under atmospheric or reduced pressure to refining treatment such as solvent deasphalting, solvent extraction, hydrocracking, solvent dewaxing, contact dewaxing, hydrofining, washing with sulfuric acid, clay treatment and the like.

Examples of synthetic lube base oils, include poly-α-olefin such as polybutene, 1-octen oligomers and 1-decene oiligomers; alkylbenzene; alkylnaphthalene; diester such as ditridecyl glutarate, di-2-ethylhexyl adipate, diisodecyl adipate, ditridecyl adipate and di-3-ethylhexyl sebacate; polyol ester such as trimethylolpropane caprylate, trimethylolpropane pelargonate, pentaerythritol-2-ethyl hexanoate and pentaerythritol pelargonate; polyoxyalkylene glycol; polyphenyl ether; silicone oil or perfluoroalkyl ether may be employed. Two or more of the above mentioned oils may also be employed as a mixture. Any viscosity ranges commonly used may be employed. More preferably, it may be 2 to 40 cSt at 100° C. The content of the base oil may be preferably 50 to 97.5 wt. % based on the total weight of the composition.

Any thickener may be employed in the base oil. For example, a soap thickener such as a metal soap and a complex metal soap; a non-soap thickener such as bentone, silica gel, urea compounds, urea-urethane compounds and urethane compounds may be employed. More preferably, urea compounds, urea-urethane compounds, urethane compounds and mixtures thereof which are superior in heat resistance may be employed.

Examples of metal soap and complex matal soap, include a sodium soap, a calcium soap, an aluminum soap, a lithium soap and the like. Example of the urea compounds, the urea-urethane compounds and the urethane compounds, include diurea compounds, triurea compounds, tetraurea compounds, polyurea compounds, urea-urethane compounds, diurethane compounds and mixtures thereof. It is preferable that diurea compounds, urea-urethane compounds, diurethane compounds and mixtures thereof be employed. More preferably, there may be employed a compound or mixtures obtained by mixing two or more compounds represented by the formula (1):

$$A-\overset{\overset{\displaystyle O}{\|}}{C}NH-R-NH\overset{\overset{\displaystyle O}{\|}}{C}-B \qquad (1)$$

wherein R stands for a divalent hydrocarbon group, and A and B may be the same or different and each stand for $R^1$—NH—, $$\begin{matrix} R^2 \\ \diagdown \\ \diagdown \\ R^3 \end{matrix} N-$$

or $R^4$—O— wherein $R^1$, $R^2$, $R^3$ and $R^4$ may be the same or different and each stand for a hydrocarbon residue having 6 to 20 carbon atoms.

The aforementioned R in the formula (1) may be preferably a divalent hydrocarbon group having 6 to 20 carbon atoms, more preferably 6 to 15 carbon atoms. As the divalent hydrocarbon group, there may preferably be employed a straight chain or branched alkylene group or alkenylene group, a cycloalkylene group or an aromatic group. For example, it may include —$(CH_2)$— and groups represented by the following formulas and the like:

$$-CH_2-\overset{\overset{\displaystyle CH_3}{|}}{\underset{\underset{\displaystyle CH_3}{|}}{C}}-CH_2-\overset{\overset{\displaystyle CH_3}{|}}{CH}-CH_2-CH_2-,$$

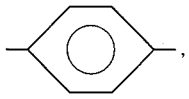

,

-continued

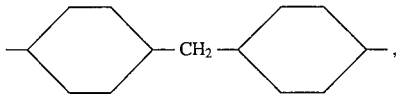

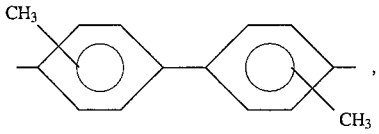

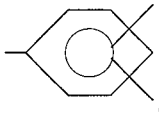

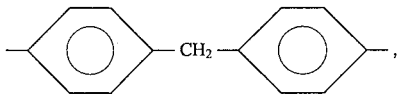

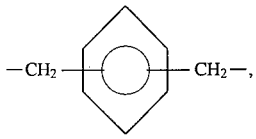

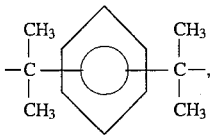

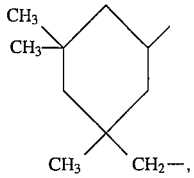

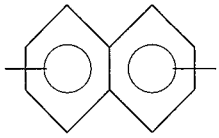

and

-continued

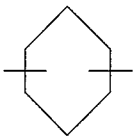

As the aforementioned $R^1$, $R^2$, $R^3$ and $R^4$, there may be preferably employed a straight chain or branched alkyl group or alkenyl group, a cycloalkyl group and an aromatic group. For example, it may include hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, eicocyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group nonadecenyl group, eicocenyl group, cyclohexyl group, methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group, heptylcyclohexyl group, octylcyclohexyl group, nonylcyclohexyl group, decylcyclohexyl group, undecylcyclohexyl group, dodecylcyclohexyl group, tridecylcyclohexyl group, tetradecylcyclohexyl group, phenyl group, toluyl group, benzyl group, ethylphenyl group, methylbenzyl group, xylyl group, propylphenyl group, cumenyl group, etheylbenzyl group, naphthyl group, methylnaphthyl group, ethylnaphthyl group, dimethylnaphthyl group and propylnaphthyl group.

The compound represented the formula ( 1 ) may include the following compounds:

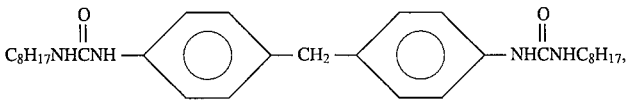

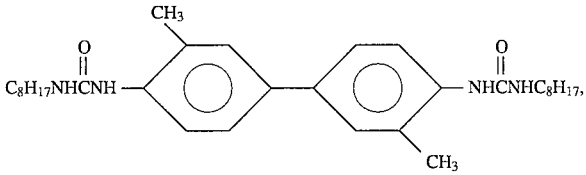

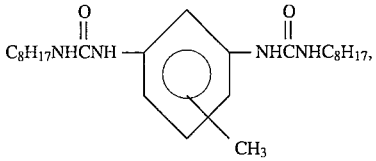

-continued
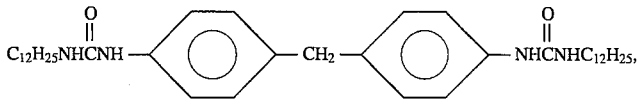
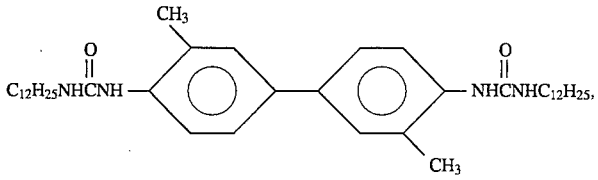
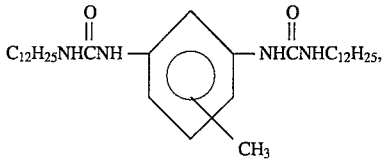
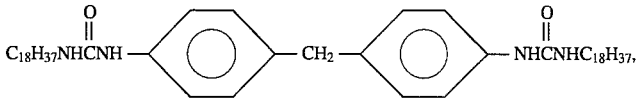
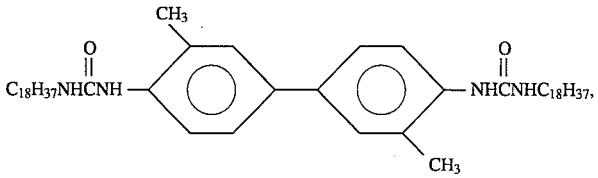
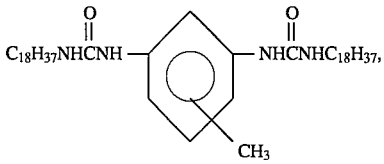
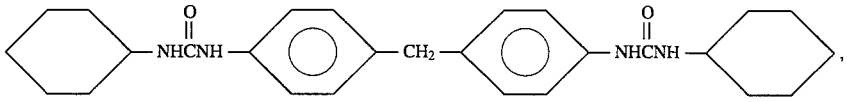
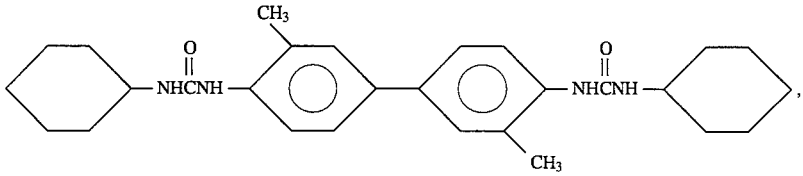
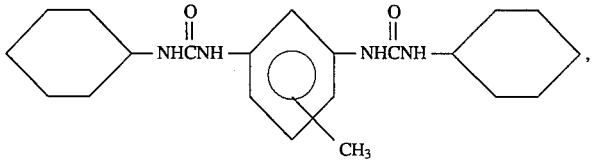
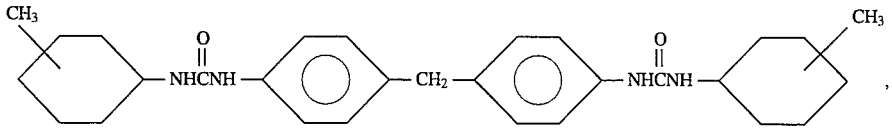

-continued
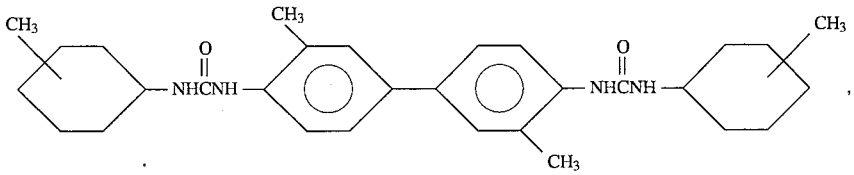
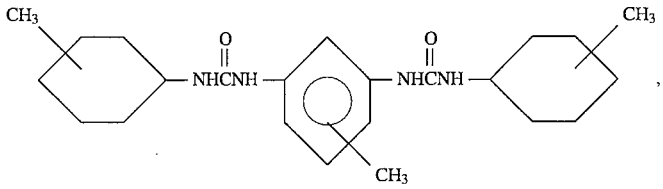
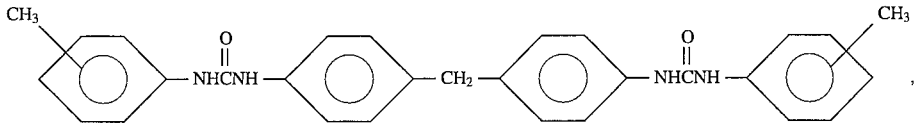
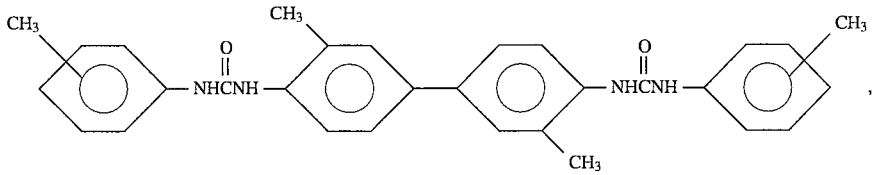
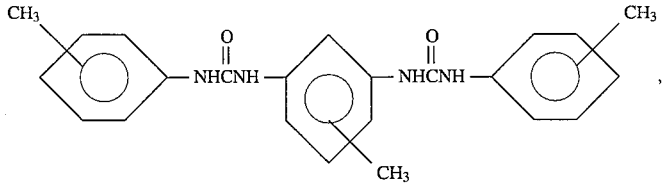
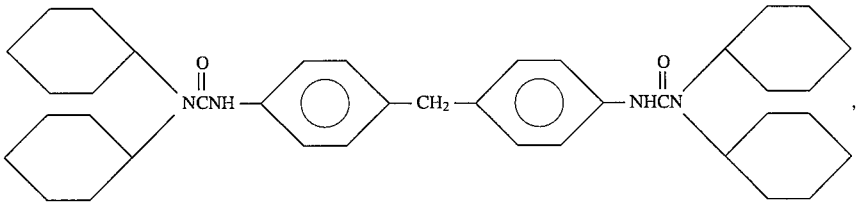
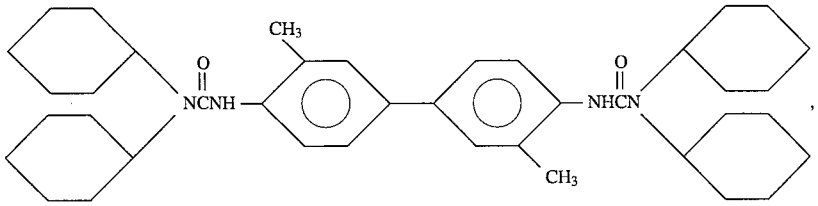
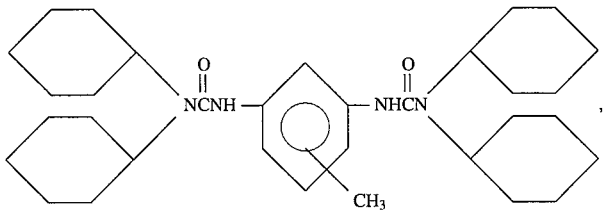
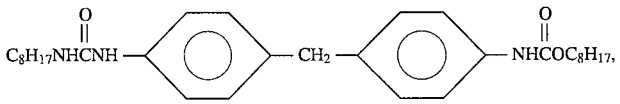

-continued
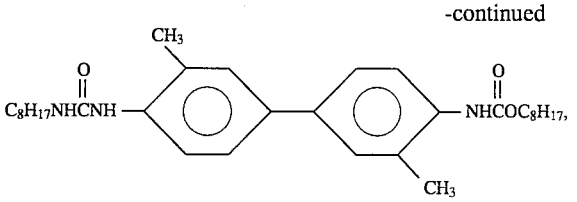
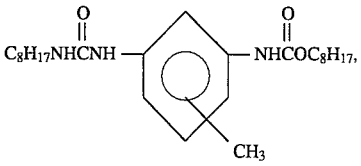
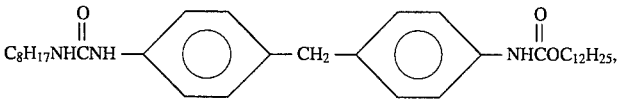
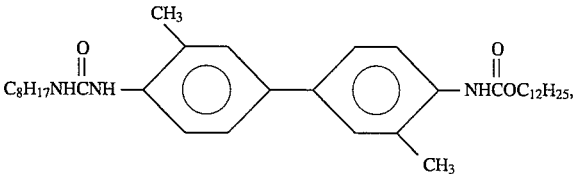
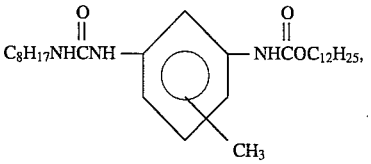
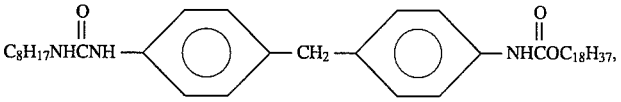
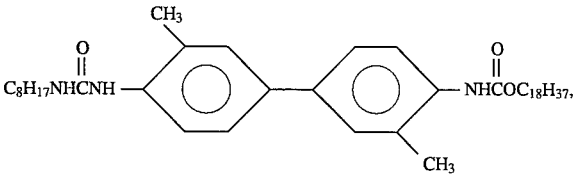
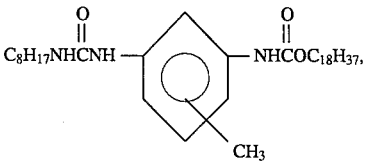
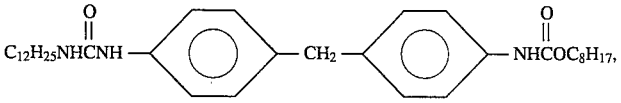
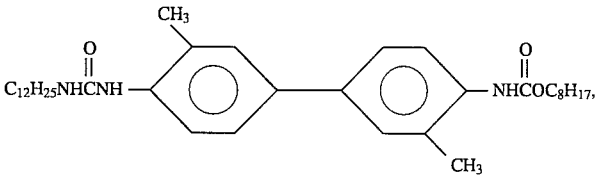

-continued
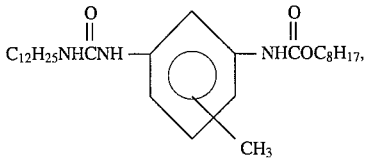
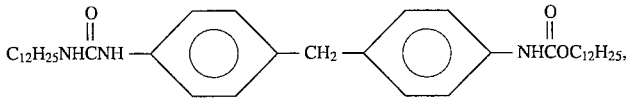
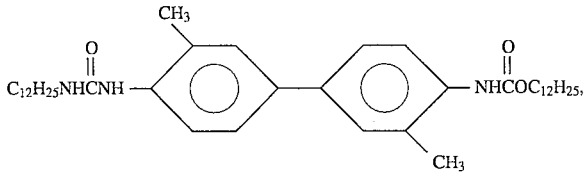
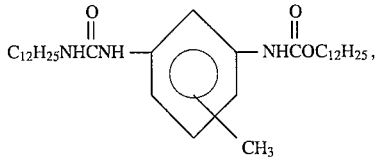
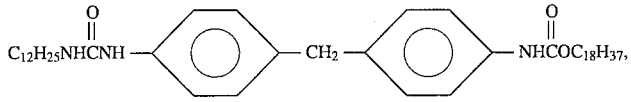
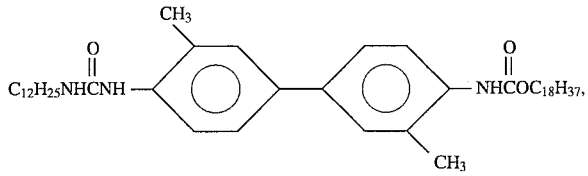
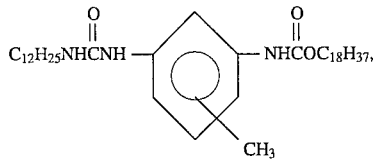
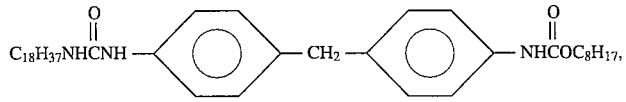
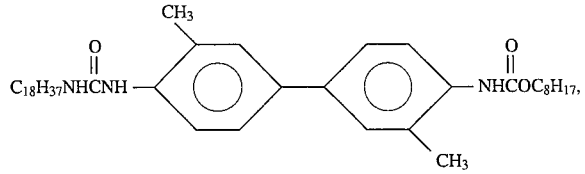
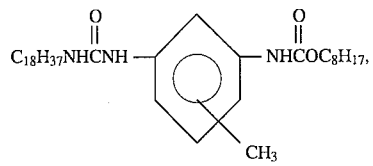
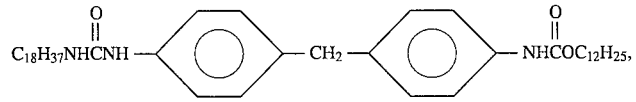

-continued
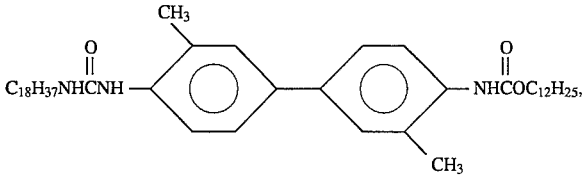
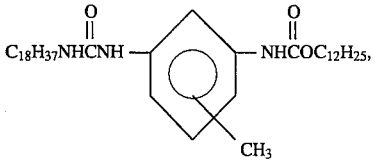
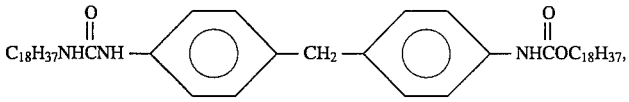
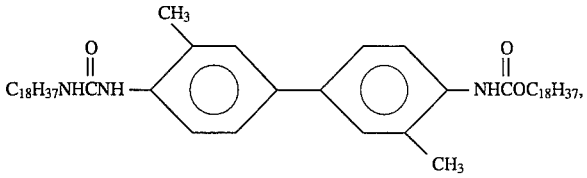
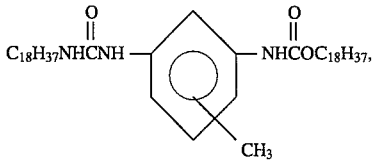
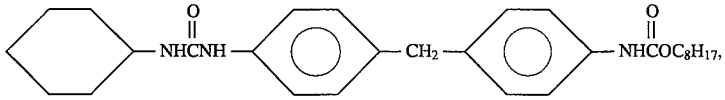
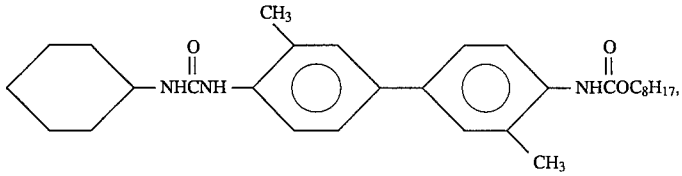
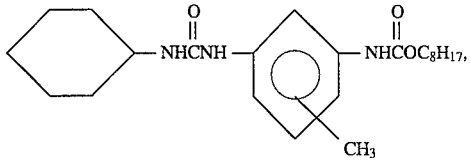
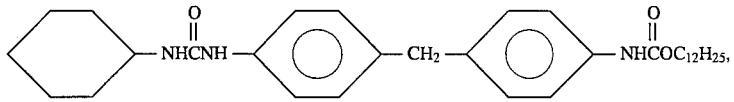
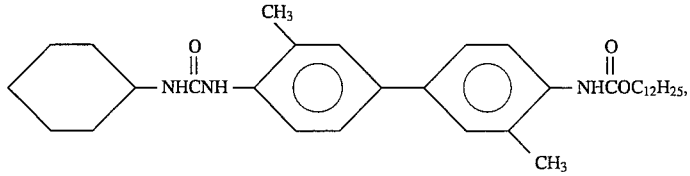

-continued
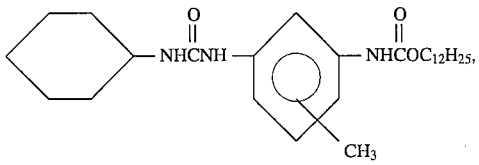
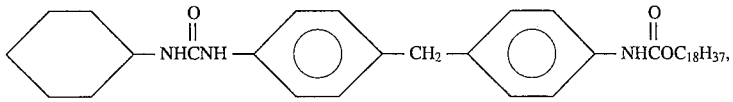
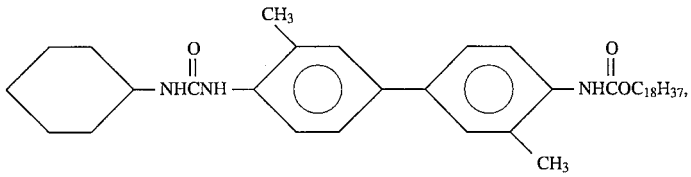
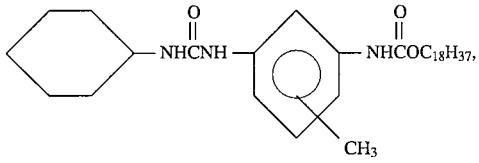
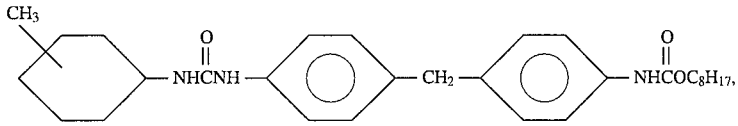
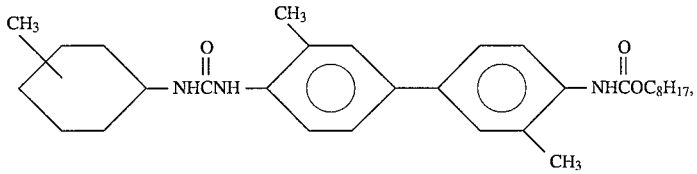
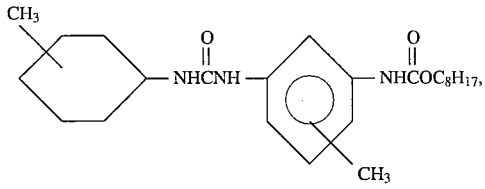
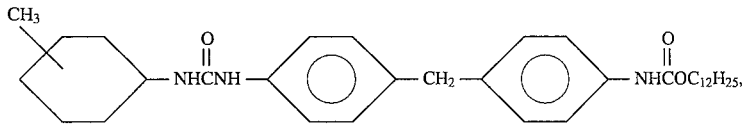
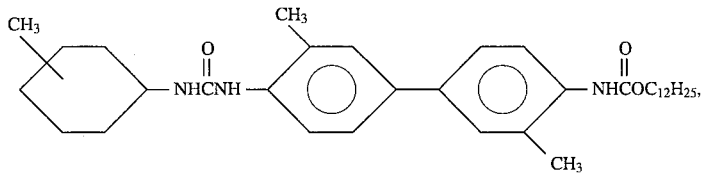
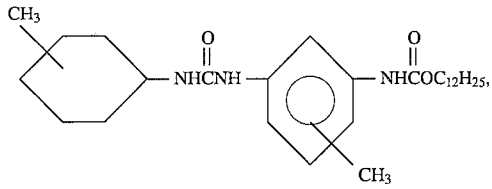

-continued
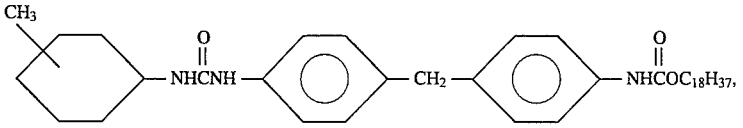
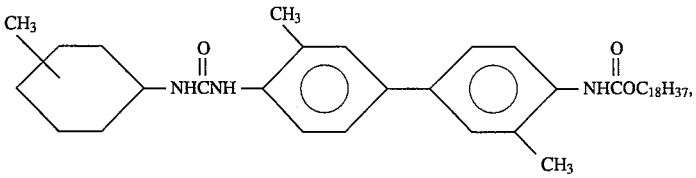
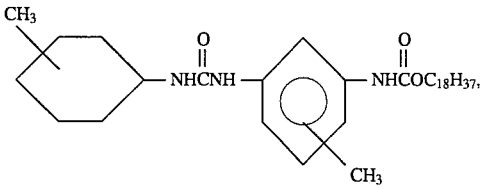
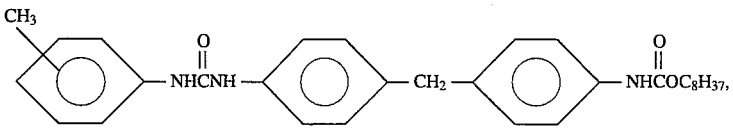
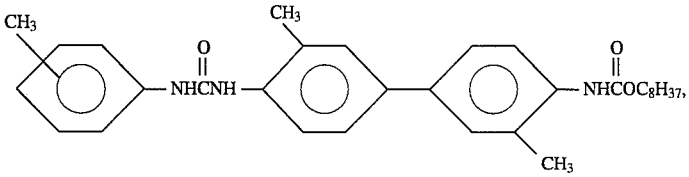
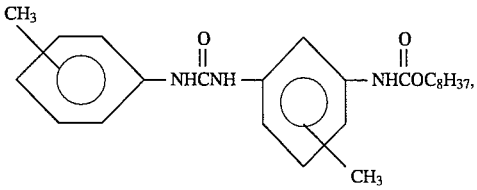
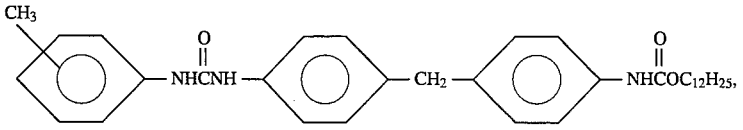
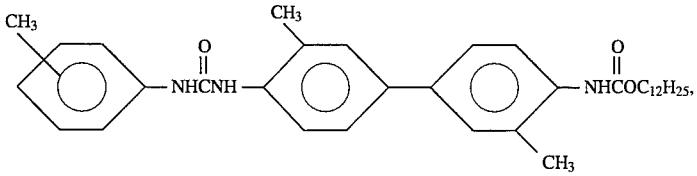
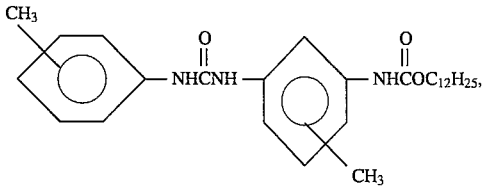
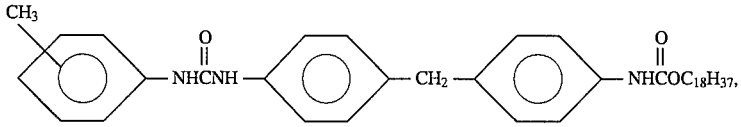

-continued
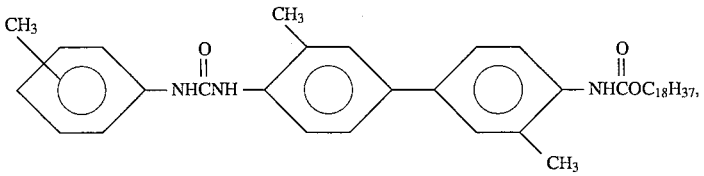
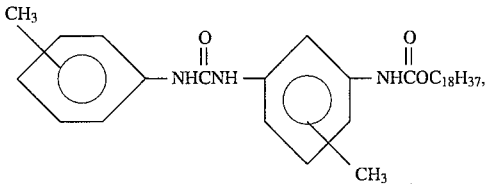
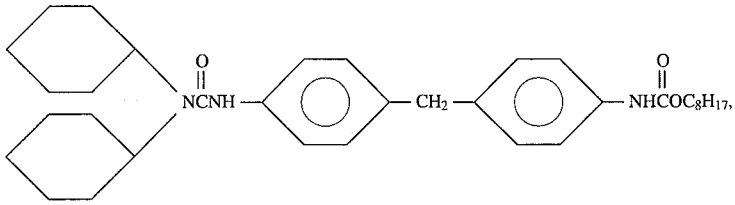
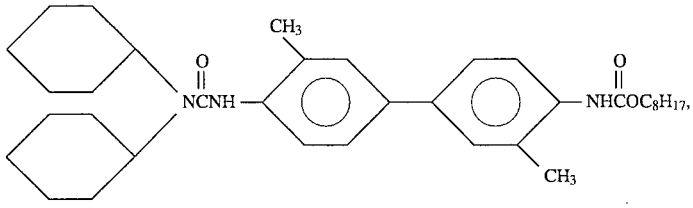
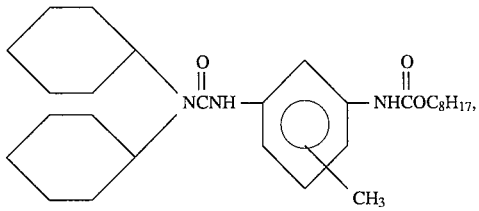
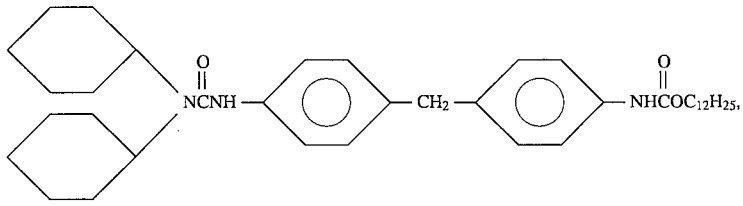
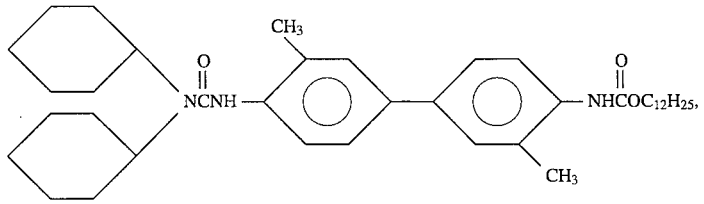
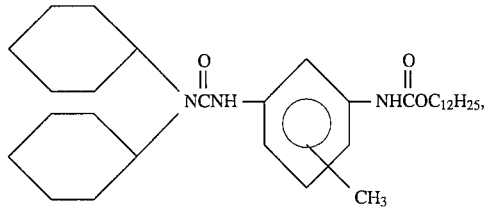

-continued
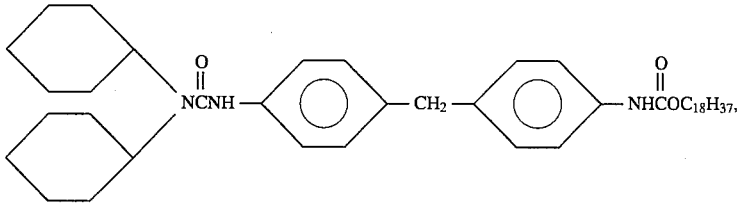
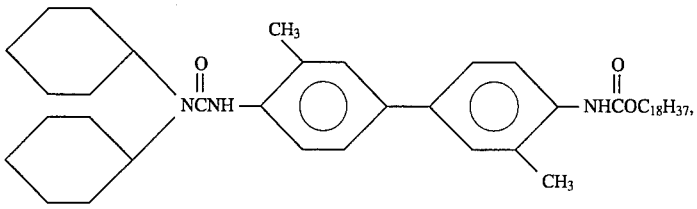
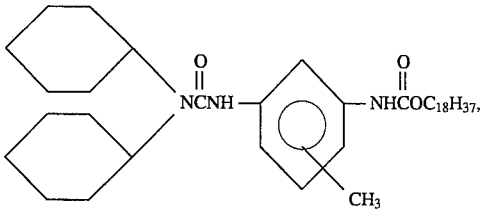
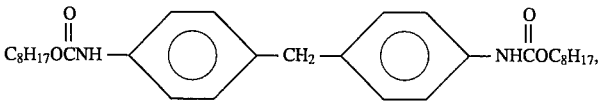
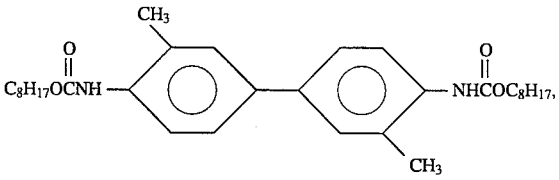
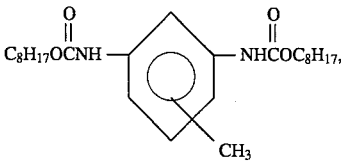
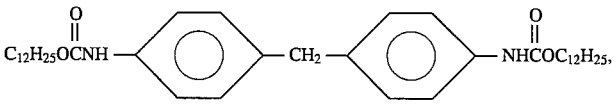
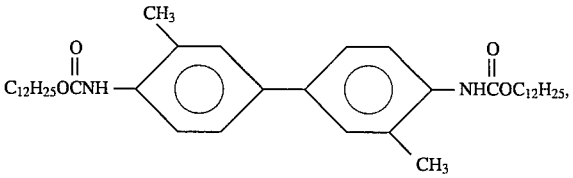
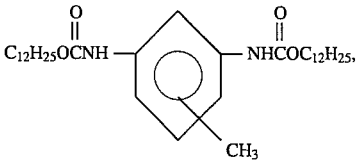
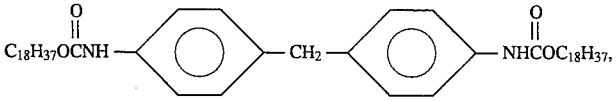

-continued

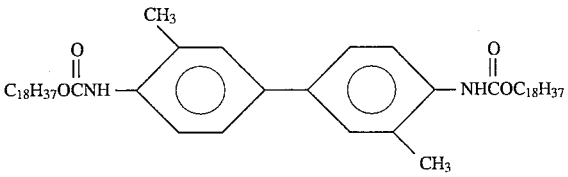

and

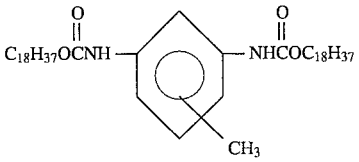

More in detail, for example, the compounds may be employed which are discribed in Japanese Patent Publication No. 55-11156, Japanese Laid-open Patent Application No. 62-250097 and Japanese Laid-open Patent Application No. 64-9296.

To prepare the diurea compound, the urea-urethane compound or the diurethane compound, for example, diisocyaneate represented by OCN—R—NCO may be reacted with a compound represented by $R^1$—$NH_2$,

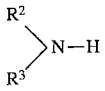

or $R^4$—OH or mixtures thereof in the base oil at the temperture of 10° to 200° C. R, $R^1$, $R^2$, $R^3$ and $R^4$ may be the same as those of the formula (1).

The content of the thickener may be preferably 2 to 25 wt. %, more preferably 3 to 20 wt. % based on the total weight of the composition. When the content is less than 2 wt. %, the amount of thickener may be so small that a sufficiently greasy state may not be obtained. When the content is above 25 wt. %, the grease may be so hard that satisfactory lubrication may not be obtained.

A particle size of the boron nitride powder contained in the base oil may not be limited. The mean particle size may be preferably in the range of 0.05 to 5 μm, more preferably 0.4 to 2 μm.

A content of the boron nitride powders may be preferably in the range of 0.5 to 20 wt. %, more preferably 1 to 10 wt. % based on the total weight of the composition. When the content is less than 0.5 wt. %, the anti-flaking performance may become less, and when the content is above 20 wt. %, the grease composition may be so hard that satisfactory lubrication may not be obtained.

To the grease composition for a constant velocity joint comprising the base oil containing the thickener and the boron nitride powders according to the present invention, if needed, an organozinc compound may be added to further improve the anti-flaking performance. Examples of organozinc which may be employed include zinc dithiophosphate represented by the formula (2), zinc dithiocarbamate represented by the formula (3), zinc salts of fatty acids represented by $(R^9COO)_2Zn$, wherein $R^9$ stands for an alkyl group or an alkenyl group, and zinc naphthenate represented by the formula (4),

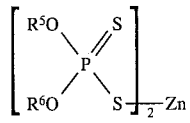

(2)

wherein $R^5$ and $R^6$ stand for an alkyl group, an aryl group, an alkalyl group or an aralkyl group having 1 to 18 carbon atoms.

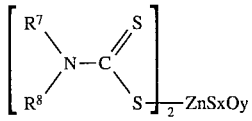

(3)

wherein $R^7$ and $R^8$ stand for an alkyl group, an aryl group, an alkaryl group or an aralkyl group having 1 to 18 carbon atoms and x and y stand for an integer of 0 to 4 and x+y=4.

$$[R^{10}(CH_2)_n]_2Zn \quad (4)$$

wherein $R^{10}$ stands for a cycloalkyl group and n stands for a positive integer.

In this invention, the content of organozinc compound may be preferably 0.1 to 10 wt. %, more preferably 1.0 to 5.0 wt. % based on the total weight of the composition. When the content is less than 0.1 wt. %, the effect of the compound may not be obtained. Above 10 wt. %, no effect is seen from the added amount of the compound.

To the grease composition for a constant velocity joint according to the present invention, there may be further added solid lubricants, extreme pressure agents, anti-oxidants, oilness agents, rust-inhibitors, viscosity index improvers and mixtures thereof to improve the performance of the composition so far as its properties are not damaged.

The solid lubricant, for example may include carbon black, fluorinated carbon black, polytetrafluoroethylene, molybdenum disulfide, antimony sulfide and alkali or alkaline earth metal borate.

The extreme pressure agent, for example may include a sulfur compound such as monosulfide, disulfide, sulfoxide and sulfinate; a phosphorus compound such as phosphate, phosphite, phosphinate, phosphonate and amine salts thereof; a chlorine compound such as chlorinated paraffin and chlorinated ester;and molybdenum compound such as molybdenum dithiophosphate and molybdenum dithiocarbamate.

The anti-oxidant, for example may include a phenol compound such as 2,6-di-t-buthyl phenol, and 2,6-di-t-buthyl-p-cresol; an amine compound such as dialkyldiphenyl amine, phenyl-α-naphthyl amine and p-alkylphenyl-α-naphthyl amine; a sulfur compound; and a phenothiazine compound.

The oilness agent, fop example may include an amine such as lauryl amine, myristyl amine, palmityl amine, stearyl amine and oleyl amine; a higher alcohol such as lauryl alcohol, myristyl alcohol, palmityl alcohol, stearyl alcohol and oleyl alcohol; a higher fatty acid such as lauric acid, myristic acid, palmitic acid, stearic acid and oleylic acid; a fatty acid ester such as methyl laurate, methyl myristate, methyl palmitate, methyl stearate and methyl oleate; an amido such as lauryl amido, myristyl amido, palmityl amido, stearyl amido and oleyl amido; and fats and oils.

The rust-inhibitor, for example may include a synthetic sulfonate such as metal soap, petroleum sulfonate, alkylbenzene sulfonate and dinonylnaphthalene sulfonate; a partial ester of polyalcohol such as sorbitan fatty acid ester; amine; phosphoric acid; and phosphate.

The viscosity index improver, for example may include polymethacrylate, polyisobuthylene and polystyrene.

To prepare the grease composition for a constant velocity joint of the present invention, the thickener and the boron nitride powders and optionally the organozinc compound and the other additives may be added to the base oil and the mixture may be stirred and then the resulting mixture may be passed through a roll mill and the like to obtain the grease composition. Further, feed components of the thickener may be preliminarily added, dissolved and stirred so that the thickener may be prepared to similarly obtain the grease composition.

The grease composition for a constant velocity joint according to the present invention contains at least both the thickener and the boron nitride powders therein so that it is superior in the anti-flaking performance and may prolong the life time of the constant velocity joint.

EXAMPLES OF THE INVENTION

The present invention will be explained in more detail with reference to Examples and Comparative Examples.

Example 1

To 97 weight parts of commercially available lithium soap grease A (60 times worked consistency : 278) containing 11 wt. % of a thickener was added 3.0 weight parts of boron nitride powders having a mean particle size of 0.7 μm. The mixture was then passed through a three-roll roll mill to produce a grease composition.

The following life time evaluating test was conducted on the produced grease. The result is shown in Table 1.

(Test for Evaluation of the Life Time)

On-Bench Durability Test

Using a commercially available perfield type joint with size #87 under the condition of the predetermined high speed and high torque, the life time of the joint was evaluated.

Example 2

88.0 g of diphenylmethane-4,4'-diisocyanate was charged into 350 g of mineral oil and heated to 60° C. so as to be dissolved uniformly therein. To this solution was added a dissolved mixture obtained by heating and dissolving 26.2 g of dodecyl alcohol in 210 g of mineral oil and the resulting mixture was agitated vigorously. After then, to the mixture was added a dissolved mixture obtained by dissolving 55.8 g of cyclohexyl amine in 210 g of mineral oil and the mixture was agitated vigorously again so that a gel-like substance was produced. After the agitation was continued at 100° C. for 30 minutes, an additive was added to the gel-like substance and the mixture was agitated and passed through a three-roll roll mill so that a grease composition was produced.

The same evaluation test according to Example 1 was carried out on the obtained grease composition. The result is shown in Table 1. The grease composition is shown hereinbelow.

| Composition | |
|---|---|
| Thickener | 17.0 wt. % |
| Mineral oil (40° C.: 126 cSt) | 77.0 wt. % |
| Boron nitride powders (mean particle size: 0.7 μm) | 1.5 wt. % |
| Pri-zinc alkyldithiophosphate | 3.5 wt. % |
| Amine anti-oxidant (60 worked consistency: 289) | 1.0 wt. % |

The above mentioned thickener is represented by the following formula:

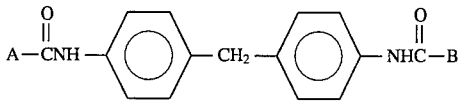

wherein A and B stand for

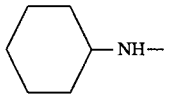

and a molar ratio of

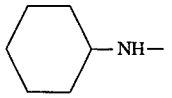

to $C_{12}H_{25}O$— is 80/20.

Example 3

To 550 g of poly-α-olefin was added 75 g of Li-12-hydroxystearate and the resulting mixture was heated to 200° C. under agitation to be dissolved. To the dissolved mixture was added 270 g of poly-α-olefin and the mixture was cooled immediately so that a gel-like substance was produced. After the agitation was continued at 100 ° C. for 30 minutes, an additive was added to the gel-like substance and the mixture was agitated and passed through a three-roll roll mill to produce a grease composition.

The same evaluation test according to Example 1 was carried out on the obtained grease composition. The result is shown in Table 1. The grease composition is shown hereinbelow.

| Composition | |
|---|---|
| Li-12-hydroxystearate | 7.5 wt. % |
| Poly-α-olefin (40° C.: 78.2 cSt) | 82.0 wt. % |
| Boron nitride powders (mean particle size: 1.6 μm) | 5.0 wt. % |
| Zinc aryldithiophosphate | 2.0 wt. % |
| Phenol anti-oxidant | 1.5 wt. % |
| Polymethacrylate (60 worked consistency: 272) | 2.0 wt. % |

Example 4

To 790 g of alkyldiphenyl ether was added 75.3 g of diphenylmethane-4,4'-diisocyanate and heated to 60° C. so as to be dissolved uniformly therein. To the mixture was then added 59.7 g of cyclohexylamine and the mixture was agitated vigorously so that a gel-like substance was produced. After the agitation was continued at 100° C. for 30 minutes, an additive was added to the mixture. The resulting mixture was passed through a three-roll roll mill to produce a grease composition.

The same evaluation test according to Example 1 was carried out on the grease composition. The result is shown in Table 1. The grease composition is shown hereinbelow.

| Composition | |
|---|---|
| Thickener | 13.5 wt. % |
| Alkyldiphenyl ether (40° C.: 122 cSt) | 79.0 wt. % |
| Boron nitride powders (mean particle size: 0.7 μm) | 2.0 wt. % |
| Sec-zinc alkyldithiophosphate | 3.0 wt. % |
| $MoS_2$ (mean particle size: 1.2 μm) | 2.5 wt. % |
| (60 worked consistency: 318) | |

The above mentioned thickener is represented by the following formula:

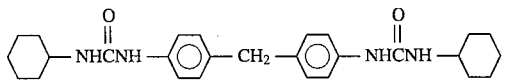

Comparative Example 1

For the commercially available lithium soap grease A employed in Example 1, the same evaluation test according to Example 1 was carried out.

The result is shown in Table 1.

Comparative Example 2

According to the method in Example 2, a grease composition having the following composition was produced.

For the obtained grease composition, the same evaluation test according to Example 1 was carried out.

The result is shown in Table 1. The grease composition is shown hereinbelow.

| Composition (Same as Example 2) | |
|---|---|
| Thickener | 17.0 wt. % |
| Mineral oil (40° C.: 126 cSt) | 78.5 wt. % |
| Pri-zinc alkyldithiophosphate | 3.5 wt. % |
| Amine anti-oxidant (60 worked consistency: 291) | 1.0 wt. % |

Comparative Example 3

According to the method of Example 4, a grease composition having the following composition was produced.

For the obtained grease composition, the same evaluation test according to Example 1 was carried out.

The result is shown in Table 1. The grease composition is shown hereinbelow.

| Composition | |
|---|---|
| Thickener (Same as Example 2) | 13.5 wt. % |
| Mineral oil (40° C.: 126 cSt) | 81.0 wt. % |
| Sec-zinc alkyldithiophosphate | 3.0 wt. % |
| $MoS_2$ (mean particle size: 1.2 μm) | 2.5 wt. % |
| (60 worked consistency: 326) | |

TABLE 1

| | Mean life time (hours) |
|---|---|
| Ex. 1 | 120 |
| Ex. 2 | 161 |
| Ex. 3 | 134 |
| Ex. 4 | 185 |
| Comp. Ex. 1 | 42 |
| Comp. Ex. 2 | 54 |
| Comp. Ex. 3 | 87 |

In the light of Table 1, the grease composition for a constant velocity joint of the present invention is superior in prolonged life time of the constant velocity joints as compared to the compositions of the Comparative Examples 1 to 3.

Although the present invention has been described with reference to the specific examples, it should be understood that various modifications and variations can be easily made by those skilled in the art without departing from the sprit of the invention. Accordingly, the foregoing disclosure should be interpreted as illustrative only and is not to be interpreted in a limiting sense. The present invention is limited only by the scope of the following claims.

What is claimed is:

1. A grease composition for a constant velocity joint comprising a base oil containing 2 to 25 wt. % of thickener, 0.5 to 20 wt. % of boron nitride powders, and 0.1 to 10 wt. % zinc dithiophosphate wherein said wt. percentages are based on total weight of the composition.

2. The grease composition according to claim 1, wherein said base oil is selected from the group consisting of petroleum lube base oil, synthetic lube base oil and mixtures thereof.

3. The grease composition according to claim 2, wherein said petroleum lube base oil is selected from the group consisting of paraffin lube base oil, naphthene lube base oil and mixtures thereof.

4. The grease composition according to claim 2, wherein said synthetic lube base oil is selected from the group consisting of polybutene, 1-octene oligomers, 1-decene oligomers, alkylbenzene, alkylnaphthalene, ditridecyl glutarate, di-2-ethylhexyl adipate, diisodecyl adipate, ditridecyl adipate, di-3-ethylhexyl sebacate, trimethylolpropane caprylate, trimethylolpropane pelargonate, pentaerythritol-2-ethyl hexanoate, pentaerythritol pelargonate, polyoxyalkylene glycol, polyphenyl ether, silicone oils, perfluoroalkyl ethers and mixtures thereof.

5. The grease composition according to claim 1, wherein a viscosity of said base oil is 2 to 40 cSt at 100° C.

6. The grease composition according to claim 1, wherein a content of said base oil is 50 to 97.5 wt. % based on total weight of the composition.

7. The grease composition according to claim 1, wherein said thickener is selected from the group consisting of soap thickeners, non-soap thickeners and mixtures thereof.

8. The grease composition according to claim 7, wherein said soap thickener is selected from the group consisting of sodium soap, calcium soap, aluminum soap, lithium soap and mixtures thereof.

9. The grease composition according to claim 7, wherein said non-soap thickener is selected from the group consisting of bentone, silica gel, diurea compounds, triurea compounds, tetraurea compounds, polyurea compounds other than said diurea, triurea and tetraurea compounds, urea-urethane compounds, diurethane compounds and mixtures thereof.

10. The grease composition according to claim 9, wherein said diurea compound, urea-urethane compound and diurethane compound are represented by the formula (1):

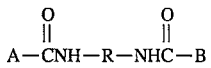

wherein R stands for a divalent hydrocarbon group, and A and B may be the same or different and each stand for $R^1$—NH—,

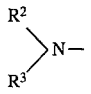

or $R^4$—O— wherein $R^1$, $R^2$, $R^3$ and $R^4$ may be the same or different and each stand for a hydrocarbon residue having 6 to 20 carbon atoms.

11. The grease composition according to claim 10, wherein said R is selected from the group consisting of —$(CH_2)$—,

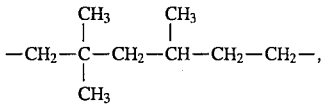

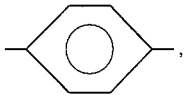

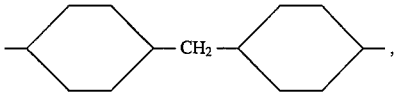

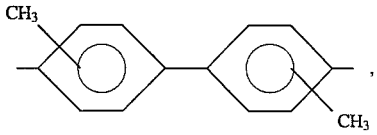

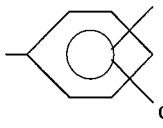

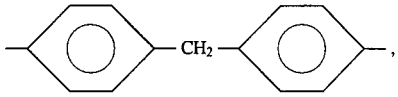

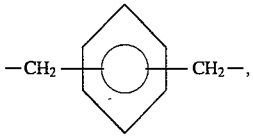

-continued

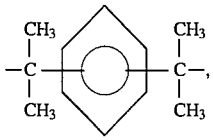

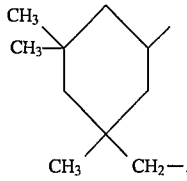

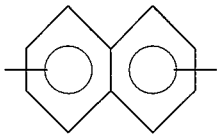

and

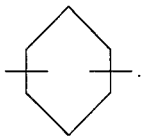

12. The grease composition according to claim 10, wherein said $R^1$, $R^2$, $R^3$ and $R^4$ are selected from the group consisting of hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, eicocyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicocenyl group, cyclohexyl group, methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group, heptylcyclohexyl group, octylcyclohexyl group, nonylcyclohexyl group, decylcyclohexyl group, undecylcyclohexyl group, dodecylcyclohexyl group, tridecylcyclohexyl group, tetradecylcyclohexyl group, phenyl group, toluyl group, benzyl group, ethylphenyl group, methylbenzyl group, xylyl group propylphenyl group, cumenyl group, ethylbenzyl group, naphthyl group, methylnaphthyl group, ethylnaphthyl group, dimethylnaphthyl group and propylnaphthyl group.

13. The grease composition according to claim 10, wherein said compound represented by the formula (1) is selected from the group consisting of

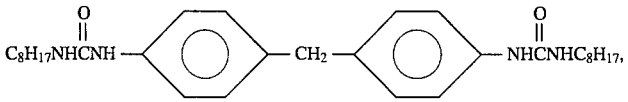

-continued
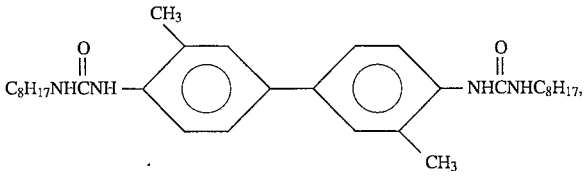
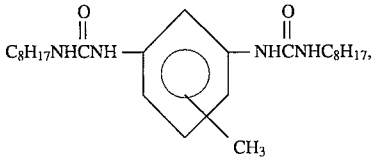
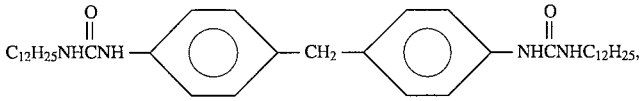
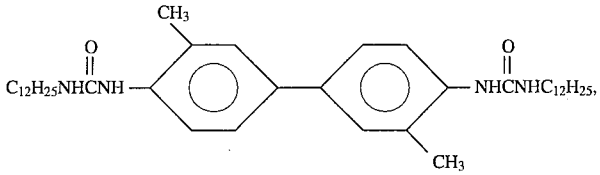
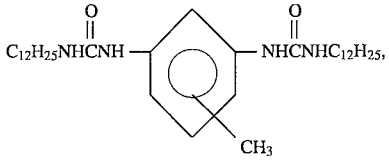
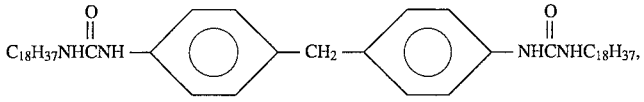
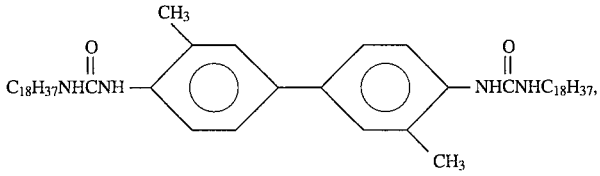
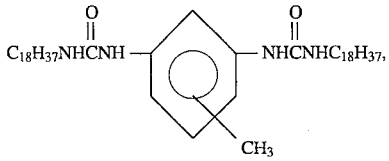
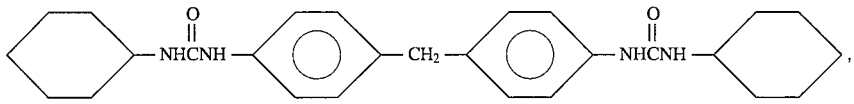
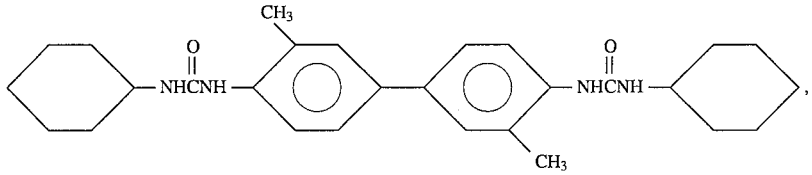

-continued
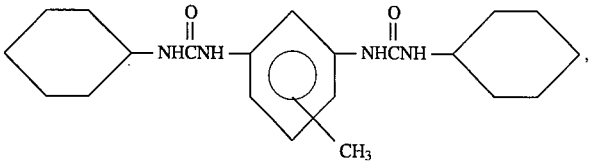
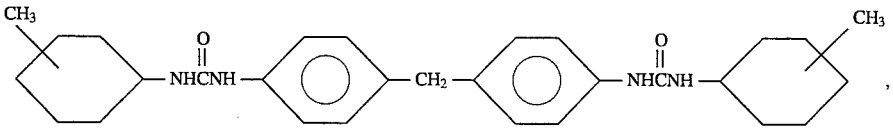
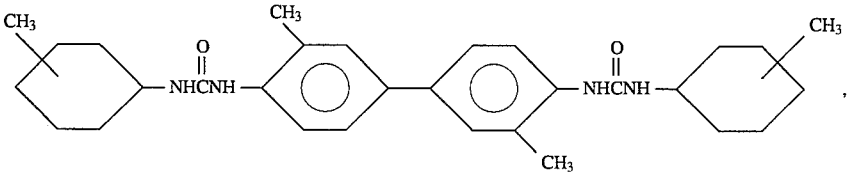
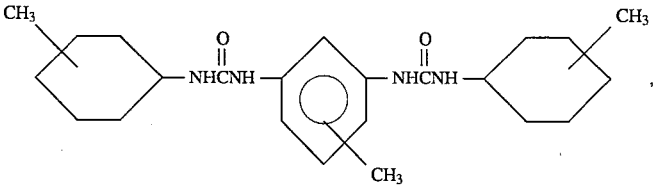
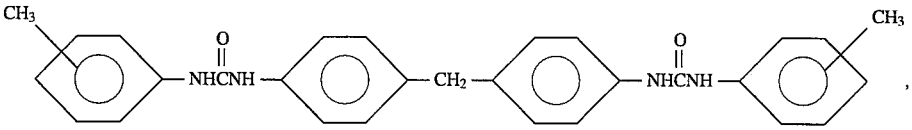
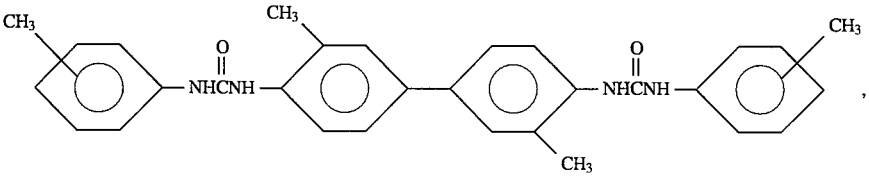
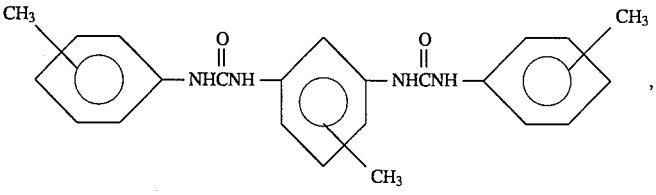
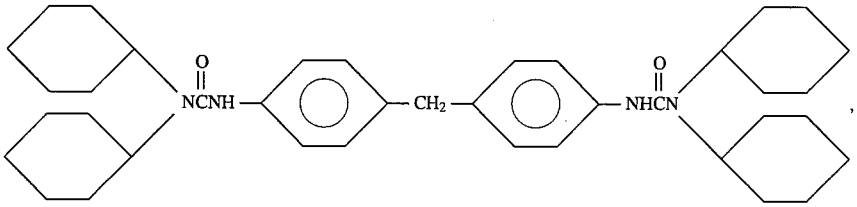
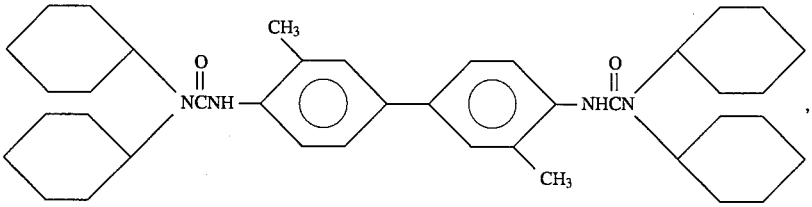

-continued
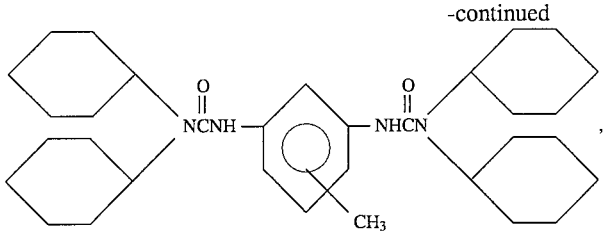
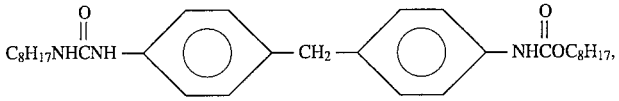
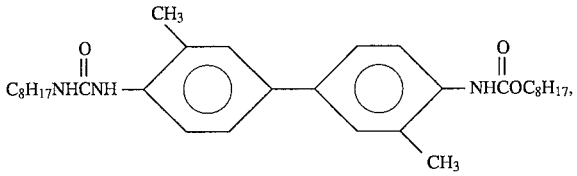
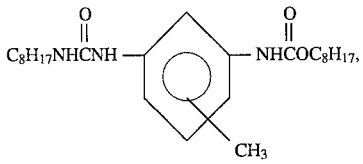
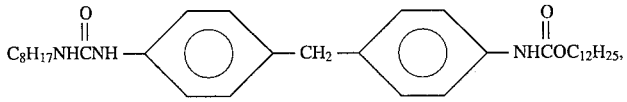
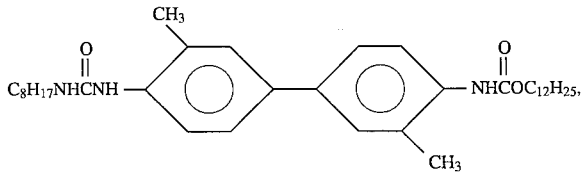
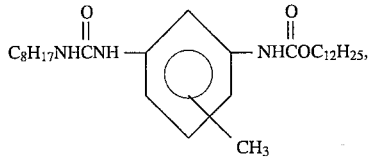
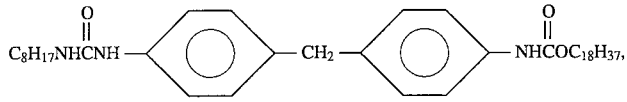
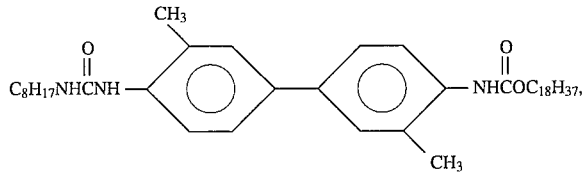
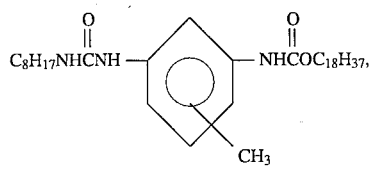

-continued
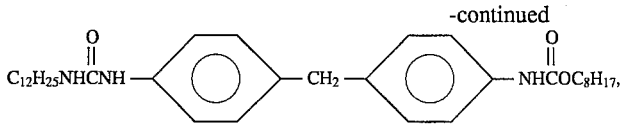
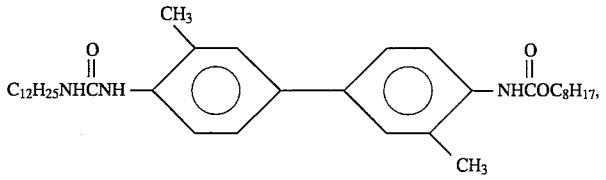
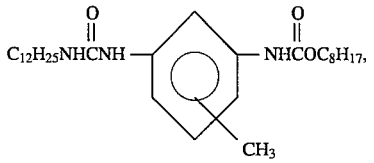
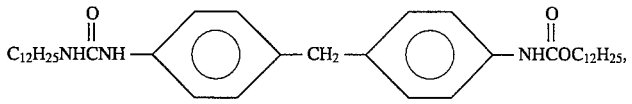
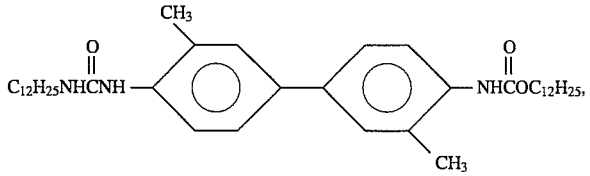
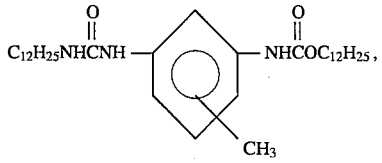
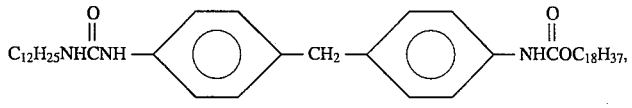
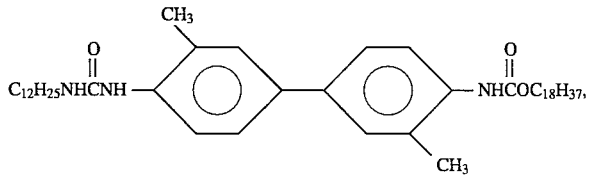
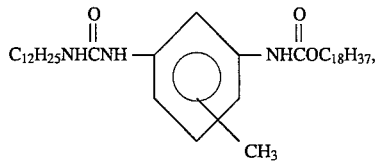
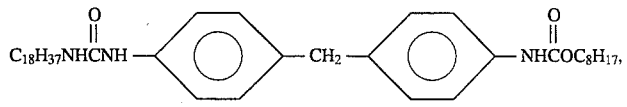
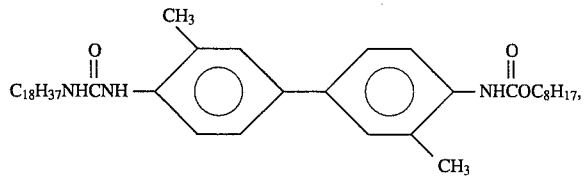

-continued
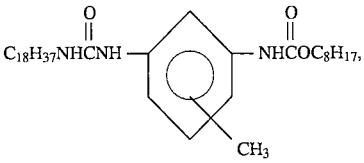
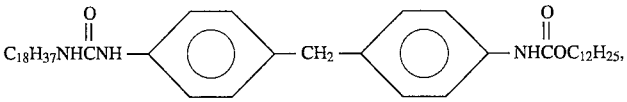
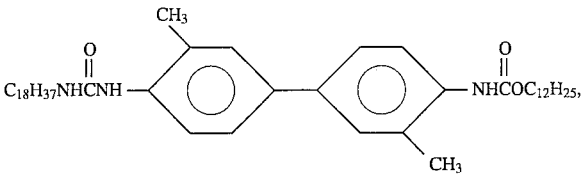
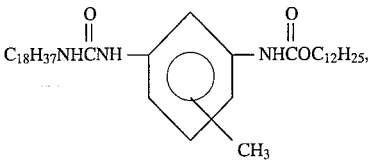
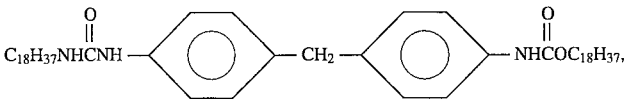
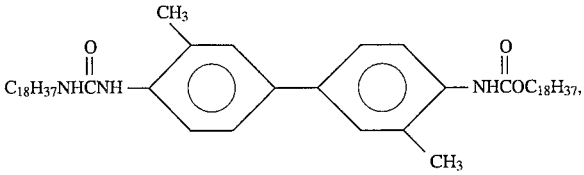
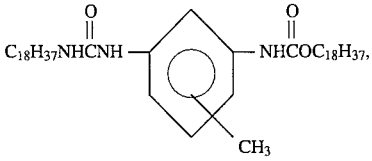
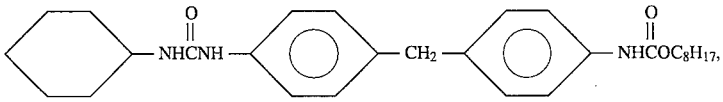
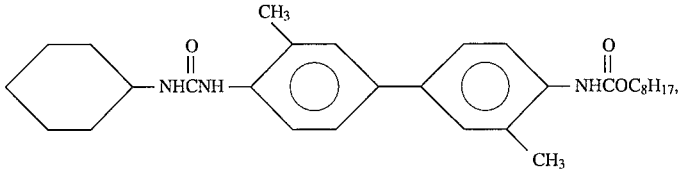
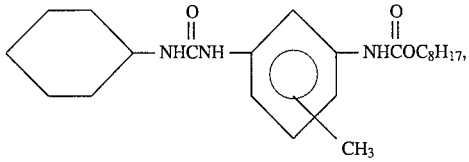
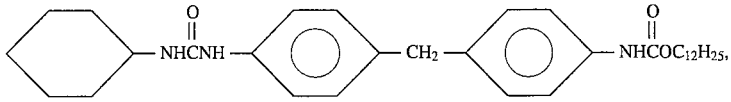

-continued
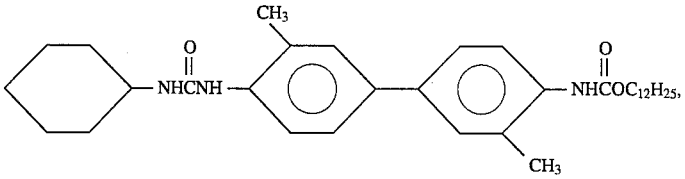
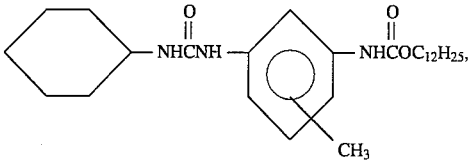
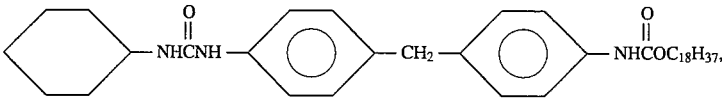
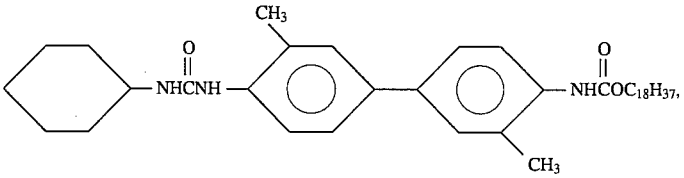
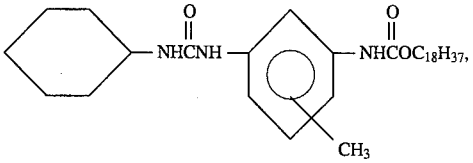
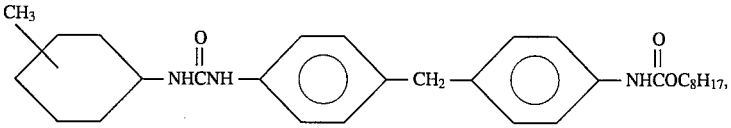
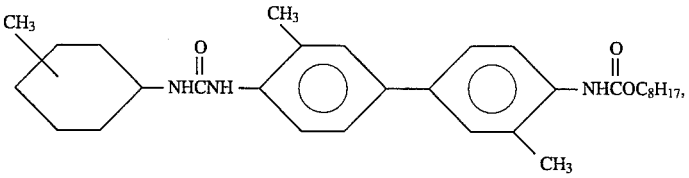
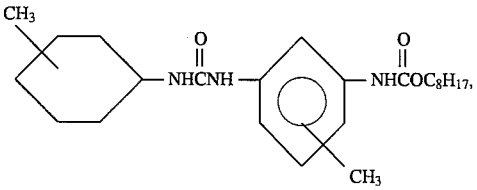
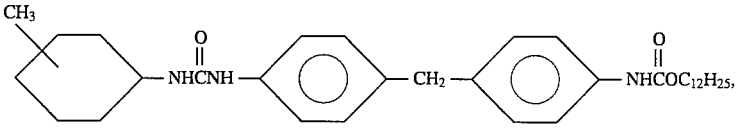
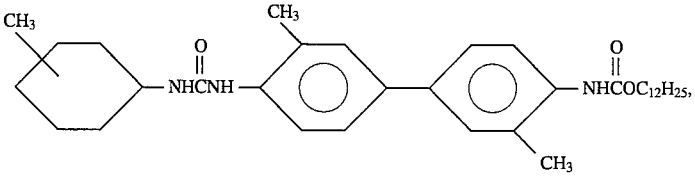

-continued
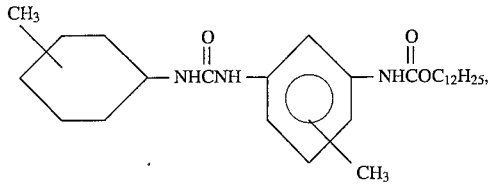
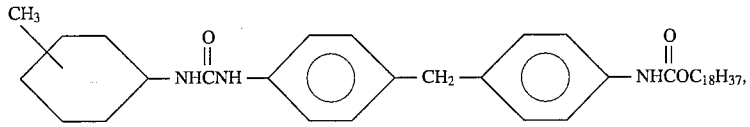
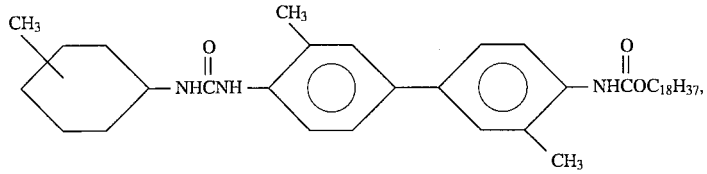
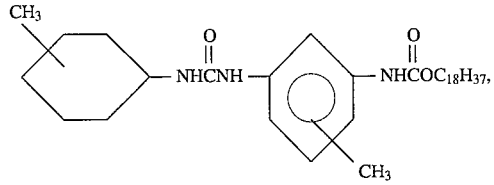
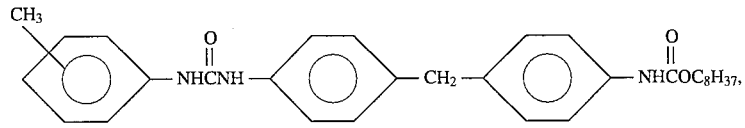
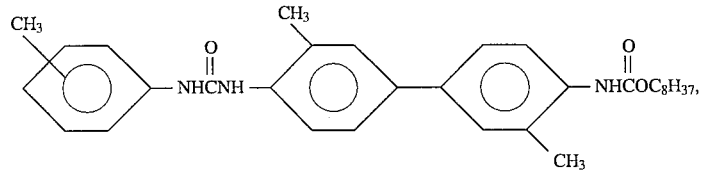
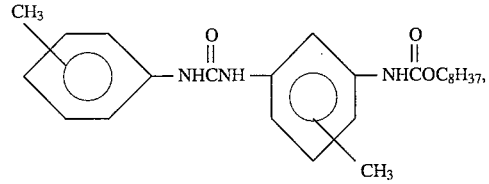
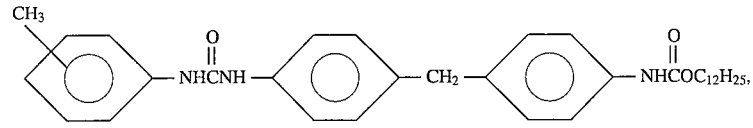
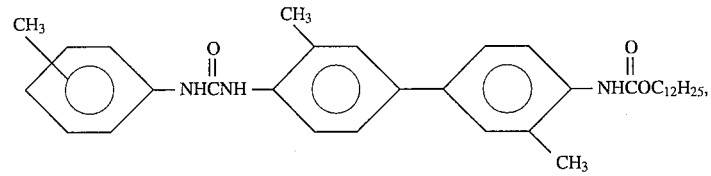

-continued
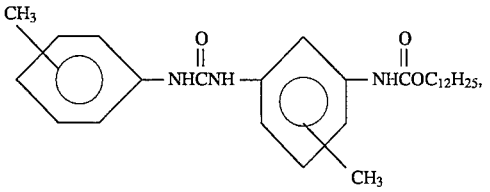
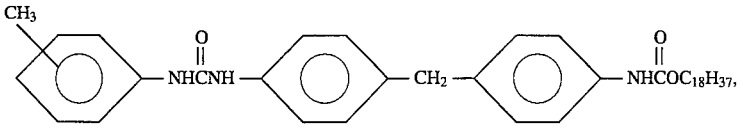
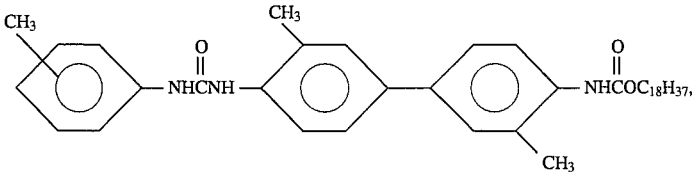
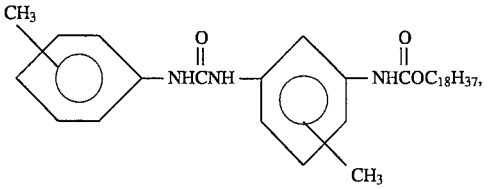
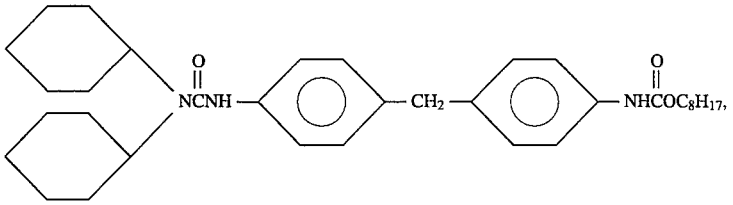
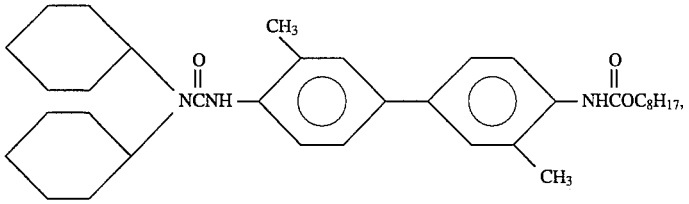
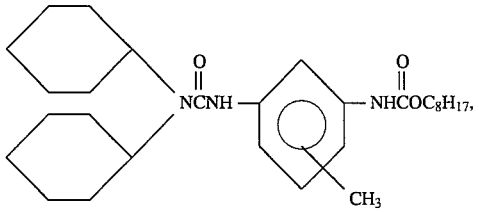
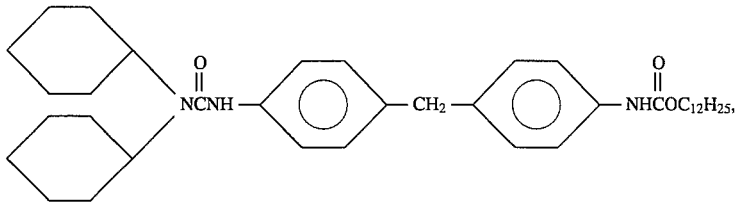

-continued
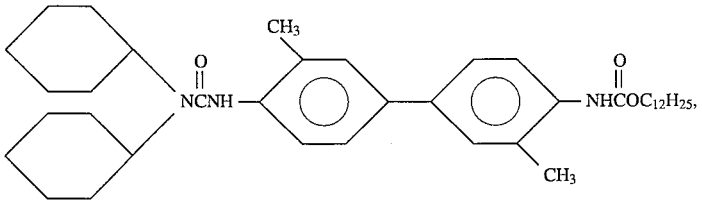
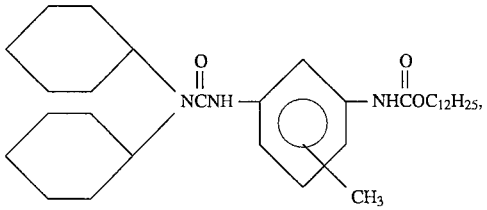
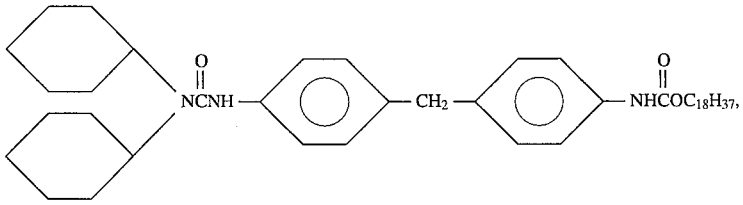
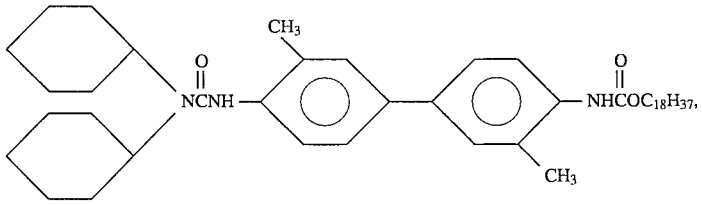
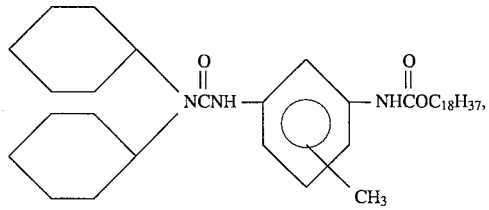
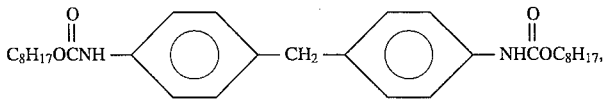
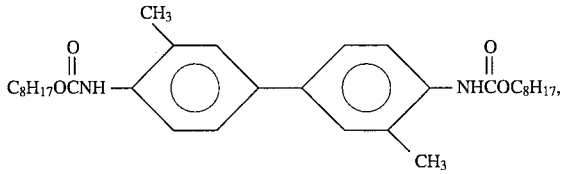
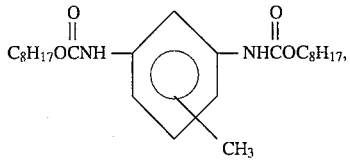
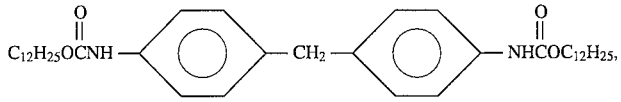

-continued

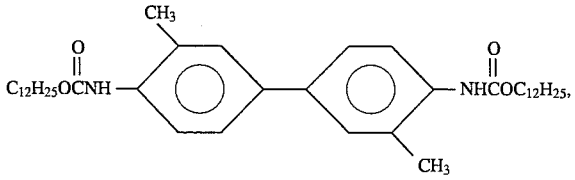

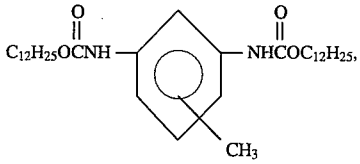

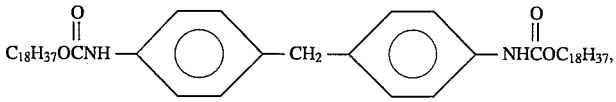

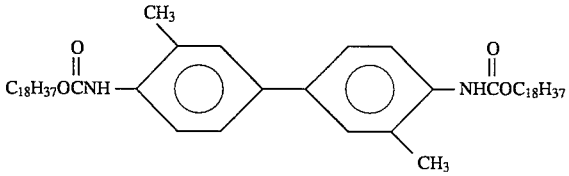

and

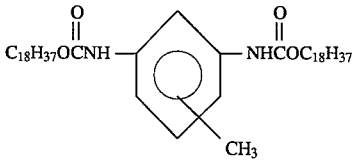

14. The grease composition according to claim 1, wherein said zinc dithiophosphate is represented by the formula (2):

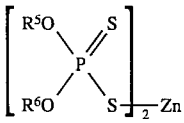

(2)

wherein $R^5$ and $R^6$ stand for an alkyl group, an aryl group, an alkaryl group or an aralkyl group having 1 to 18 carbon atoms.

15. The grease composition according to claim 1 further comprising a solid lubricant, extreme pressure agent, anti-oxidant, oilness agent, rust-inhibitor, viscosity index improver or mixtures thereof.

16. The grease composition according to claim 1 wherein said boron nitride powders are contained in an amount of 0.5 to 10 wt. % based on total weight of the composition.

17. The grease composition according to claim 1 wherein said zinc dithiophosphate is contained in an amount of 1.0 to 5.0 wt. % based on total weight of the composition.

18. The grease composition according to claim 1 wherein said boron nitride powders are contained in an amount of 0.5 to 10 wt. % based on total weight of the composition, and said zinc dithiophosphate is contained in an amount of 1.0 to 5.0 wt. % based on total weight of the composition.

19. The grease composition according to claim 1, wherein said boron nitride powders have mean particle size of 0.4 to 2 μm.

* * * * *